US010563656B2

(12) United States Patent
Paust et al.

(10) Patent No.: US 10,563,656 B2
(45) **Date of Patent: *Feb. 18, 2020**

(54) FLUIDICS MODULE, DEVICE AND METHOD FOR PUMPING A LIQUID

(71) Applicant: Hahn-Schickard-Gesellschaft fuer angewandte Forschung e.V., Villingen-Schwenningen (DE)

(72) Inventors: Nils Paust, Freiburg (DE); Steffen Zehnle, Freiburg (DE); Felix Von Stetten, Freiburg-Tiengen (DE)

(73) Assignee: HAHN-SCHICKARD-GESELLSCHAFT FÜR ANGEWANDTE FORSCHUNG E.V., Villingen-Schwenningen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/009,341

(22) Filed: Jun. 15, 2018

(65) Prior Publication Data

US 2018/0291912 A1 Oct. 11, 2018

Related U.S. Application Data

(63) Continuation of application No. 14/459,530, filed on Aug. 14, 2014, now Pat. No. 10,001,125, which is a (Continued)

(30) Foreign Application Priority Data

Feb. 23, 2012 (DE) ..... 10 2012 202 775

(51) Int. Cl.
*F04D 17/10* (2006.01)
*F04F 1/00* (2006.01)
(Continued)

(52) U.S. Cl.
CPC ..... *F04D 17/10* (2013.01); *B01F 13/0059* (2013.01); *B01F 15/0233* (2013.01);
(Continued)

(58) Field of Classification Search
CPC ..... B01F 11/0002; B01F 11/0014; B01F 13/0059; B01F 15/0233; B01F 15/0201;
(Continued)

(56) References Cited

U.S. PATENT DOCUMENTS 6,063,589 A * 5/2000 Kellogg ..... B01F 13/0059
6,863,867 B2 * 3/2005 Vanden Bussche ..... B01F 5/04 422/129

(Continued)

FOREIGN PATENT DOCUMENTS

DE 10 2009 050 979 A1 5/2011
DE 102013215002 B3 * 11/2014 ..... B01L 3/50273
WO WO-2015189280 A1 * 12/2015 ..... B01L 3/50273

OTHER PUBLICATIONS

Paust et al., "Fluidics Module, Device and Method for Pumping a Liquid", U.S. Appl. No. 14/459,530, filed Aug. 14, 2014.

*Primary Examiner* — Charles Cooley
(74) *Attorney, Agent, or Firm* — Keating & Bennett, LLP

(57) ABSTRACT

A fluidics module rotatable about a rotational center includes first and second chambers and a compression chamber. First and second fluid channels are provided between the first and second chambers and the compression chamber, respectively. The flow resistance of the second fluid channel is smaller, for a flow of liquid from the compression chamber to the second chamber, than a flow resistance of the first fluid channel for a flow of liquid from the compression chamber to the first chamber. Upon rotation at a high rotational frequency, liquid is initially introduced from the first chamber into the compression chamber via the first fluid channel, so that a compressible medium is compressed within the
(Continued)

compression chamber. Subsequently, the rotational frequency is reduced, so that the compressible medium within the compression chamber will expand and so that, thereby, liquid is driven into the second chamber via the second fluid channel.

15 Claims, 4 Drawing Sheets

Related U.S. Application Data continuation of application No. PCT/EP2013/053243, filed on Feb. 19, 2013.

(51) Int. Cl.
*B01F 13/00* (2006.01)
*B01L 3/00* (2006.01)
*B01F 15/02* (2006.01)

(52) U.S. Cl.
CPC ..... *B01L 3/50273* (2013.01); *F04F 1/00* (2013.01); *B01L 2200/0621* (2013.01); *B01L 2200/0684* (2013.01); *B01L 2300/0803* (2013.01); *B01L 2400/0409* (2013.01); *B01L 2400/0442* (2013.01)

(58) Field of Classification Search
CPC ..... F04D 17/10; F04F 1/00; B01L 3/50273; B01L 2200/0621; B01L 2400/0442; B01L 2200/0684; B01L 2300/0803; B01L 2400/0409
USPC ... 366/92–93, 130, 237, 341, DIG. 1–DIG. 4
See application file for complete search history.

(56) References Cited

U.S. PATENT DOCUMENTS 7,275,858 B2 * 10/2007 Andersson ..... B01F 5/0646 366/341
7,819,138 B2 * 10/2010 Lee ..... G05D 7/0694 137/38
8,372,357 B2 * 2/2013 Andersson ..... F16K 99/0001 137/38
8,906,323 B2 * 12/2014 Momose ..... B01L 3/50273 422/502
8,951,417 B2 * 2/2015 Strohmeier ..... B01L 3/502761 210/695
9,180,418 B2 * 11/2015 Cho ..... B01F 11/0002
9,211,512 B2 * 12/2015 Kim ..... B01L 3/50273
9,555,382 B2 * 1/2017 Clime ..... B01F 5/0606
9,868,120 B2 * 1/2018 Boehm ..... B01L 3/5027
9,901,925 B2 * 2/2018 Imran ..... B01J 19/0093
9,914,120 B2 * 3/2018 De Oliveira Garcia Da Fonseca ..... G01N 33/491
9,962,699 B2 * 5/2018 Boehm ..... B01L 3/502723
10,001,125 B2 * 6/2018 Paust ..... F04F 1/00
10,058,864 B2 * 8/2018 Lee ..... B01L 3/50273
10,350,598 B2 * 7/2019 Schwemmer ..... B01L 3/50273
2003/0044322 A1 * 3/2003 Andersson ..... B01F 5/0646 422/506
2006/0281192 A1 * 12/2006 Harding ..... B01F 13/0059 436/180
2008/0056063 A1 * 3/2008 Cho ..... B01F 11/0002 366/228
2008/0108120 A1 * 5/2008 Cho ..... B01F 13/0059 435/173.7
2008/0156079 A1 * 7/2008 Momose ..... B01L 3/502715 73/61.44
2009/0075801 A1 * 3/2009 Hodko ..... B01L 3/50273
2009/0104077 A1 * 4/2009 Momose ..... B01L 3/50273 422/72
2009/0155925 A1 * 6/2009 Boehm ..... B01F 1/0022
2009/0269854 A1 * 10/2009 Kageyama ..... B01F 11/0002 436/177
2010/0307595 A1 * 12/2010 Mark ..... B01L 3/50273 137/1
2012/0021447 A1 * 1/2012 Garcia Da Fonseca ..... B01L 3/50273 435/24
2013/0206701 A1 * 8/2013 Strohmeier ..... B01L 3/502761 210/695
2014/0109972 A1 * 4/2014 Garcia Da Fonseca ..... B01L 3/502738
2014/0352410 A1 * 12/2014 Esteves Reis .... B01L 3/502753 73/61.44
2014/0356129 A1 * 12/2014 Paust ..... F04F 1/00 415/1
2016/0214104 A1 * 7/2016 Schwemmer ..... B01L 3/50273
2016/0214105 A1 * 7/2016 Paust ..... B01L 3/502769
2017/0095812 A1 * 4/2017 Boehm ..... B01L 3/5027
2017/0216837 A1 * 8/2017 Schwemmer ..... B01L 3/50273
2018/0056290 A1 * 3/2018 Xu ..... B01L 3/502
2019/0070607 A1 * 3/2019 Czilwik ..... B01L 3/502723
2019/0091686 A1 * 3/2019 Kellogg ..... B01L 3/502738

* cited by examiner

FLUIDICS MODULE, DEVICE AND METHOD FOR PUMPING A LIQUID

CROSS-REFERENCE TO RELATED APPLICATIONS

This application is a continuation of copending International Application No. PCT/EP2013/053243, filed Feb. 19, 2013, which is incorporated herein by reference in its entirety, and additionally claims priority from German Application No. 102012202775.0, filed Feb. 23, 2012, which is also incorporated herein by reference in its entirety.

BACKGROUND OF THE INVENTION

Rotors for processing liquid are used, in particular, in centrifugal microfluidics. Appropriate rotors contain chambers for receiving liquid and channels for routing fluid. Under centripetal acceleration of the rotor, the liquid is forced radially outward and may thus arrive at a radially outer position by means of corresponding fluid routing. Centrifugal microfluidics is applied mainly in the field of life sciences, in particular in laboratory analytics. It serves to automate process runs and to perform operations such as pipetting, mixing, measuring, aliquoting and centrifuging in an automated manner.

The centrifugal force used for performing such operations acts radially outward, so that in conventional rotors, liquid is pumped radially outward only, rather than radially inward from a radially outer position to a radially inner position. Thus, the fluidic path and, therefore, also the number of fluidic processes within the rotor are limited by the radius of the rotor. Consequently, studies comprising a large number of fluidic processes may use large rotors which guarantee the radial path that may be used. However, large rotors cannot be employed in standard devices and limit the maximum rotational frequency while, in addition, a large part of the rotor surface area remains unused.

In order to increase the density of fluidic unit operations in such centrifuge rotors, and/or in order to reduce the sizes of centrifuge rotors, it is indispensable to make use of rotors not only in terms of their radial lengths, but also in terms of their surface areas. To be able to realize this, it is advantageous or useful to move sample liquid in centrifuge rotors radially inward, i.e. to pump them inward.

Different techniques of implementing inward pumping within centrifuge rotors are known from conventional technology. Most known techniques utilize active inward pumping, i.e. inward pumping realized by means of external tools.

For example, inward pumping while using an external pressure source is described in Kong et al., "Pneumatically Pumping Fluids Radially Inward On Centrifugal Microfluidic Platforms in Motion", Letters to Anal. Chem., 82, pp. 8039-8041, 2010.

Thermopneumatic inward pumping of liquid under centrifugation by means of heating air via infrared radiation is described in Abi-Samra et al., "Thermo-pneumatic pumping in centrifugal microfluidic platforms", Microfluid Nanofluid, DOI 10.1007/s10404-011-0830-5, 2011, and Abi-Samra et al., "Pumping fluids radially inward on centrifugal microfluidic platforms via thermally-actuated mechanisms", μTAS conference paper, 2011.

In addition, U.S. Pat. No. 7,819,138 B2 describes a microfluidic device wherein liquid is pumped radially inward in idling disc rotors by means of an external air pressure source.

In addition to such active approaches to effecting inward pumping of liquid in centrifugal systems, techniques have been known wherein by using the centrifugal acceleration field acting upon a liquid in a rotating disc, pneumatic energy is produced and stored for later utilization for reversing the flow direction of the liquid when centrifugal acceleration is used. For example, Noroozi et al., "A multiplexed immunoassay system based upon reciprocating centrifugal microfluidics", Review of Scientific Instruments, 82, 064303 (2011), discloses a fluidics system wherein a pressure chamber is arranged radially inward of a reaction chamber, an air bubble being trapped and compressed within the pressure chamber during centrifugal filling of the reaction chamber at a high rotational frequency. Upon reduction of the rotational frequency, the air bubble within the pressure chamber will expand again, so that a backward movement of the liquid will take place within the reaction chamber. In this manner, efficient mixing is made possible.

In addition, in Noroozi et al., "Reciprocating flow-based centrifugal microfluidics mixer", Review of Scientific Instruments, 80, 075102, 2009, a method of mixing liquids is known, wherein two inlets of a mixing chamber are fluidically connected to liquid chambers, whereas outlets of the chamber are connected to an air chamber. Upon centrifugal filling of the mixing chamber, air is trapped and compressed within the air chamber. Upon reduction of the rotational frequency, the air trapped within the air chamber expands, so that a backward flow may be produced within the mixing chamber. □y alternately increasing and reducing the rotational frequency, efficient mixing of the liquids within the mixing chamber is to be achieved.

In Gorkin et al., "Pneumatic pumping in centrifugal microfluidic platforms", Microfluid Nanofluid (2010) 9:541-549, pneumatic pumping in centrifugal microfluidic platforms is described. An inlet chamber is connected to a pressure chamber via a fluid channel which extends radially outward. Under the action of a centrifugal force, which is effected by rotation at a high rotational frequency, liquid is driven from the inlet chamber into the pressure chamber, where an air bubble is trapped and compressed. Upon reduction of the rotational frequency, the air bubble expands again, and the liquid is moved back into the inlet channel. Thus, pumping back of liquid takes place on the same path. In addition, said document describes a further application wherein an outlet chamber is connected to the pressure chamber via a syphon. Given a sufficiently high rotational frequency, the levels of the liquid in the inlet channel, the pressure chamber and the outlet syphon are nearly in equilibrium, while the air volume remaining within the pressure chamber is compressed. Upon reduction of the rotational frequency, the centrifugal force acting upon the liquid becomes smaller, and the compressed air expands, so that liquid is pumped into the inlet channel and into the syphon. In this manner, the syphon may be filled, and the pressure chamber may be emptied into the outlet chamber via the syphon.

In the known methods of inward pumping, tools such as external compressional waves, heating devices or wax valves are thus used, on the one hand. Said tools constitute materials and peripheral devices which are an addition to the rotor, and consequently, they are costly. Moreover, the control of the peripheral devices and the processes within the rotor are complex. Furthermore, these methods are very time-consuming. For example, inward pumping of 68 μl of sample liquid by using an external pressure source takes 60 seconds, as is described by Kong et al., for example. For thermopneumatic pumping as is described, e.g., in Abi- Samra et al., a pumping rate of 7.6±1.5 μl/min is indicated. A further disadvantage of the method in which an external pressure source is used consists in that there is a limited rotational frequency range from 1.5 Hz to 3.0 Hz within which the method works reliably. For thermopneumatic inward pumping, a sealed pressure chamber may be used for the air which is to be heated. Such a pressure chamber has been realized, in the methods described, by melting and solidifying of wax valves, which constitutes an irreversible process, however.

For the method described in U.S. Pat. No. 7,819,138 B2, the rotor is stopped, which may cause undesired inertia and surface effects due to the resulting disruption of the centrifugal force.

Finally, the method described by Gorkin is restricted to returning the sample liquid from the outside to the inside on the same fluidic path back to the original radial position, or to filling a syphon. General inward pumping through a further fluidic path to a position which is radially further inward is therefore not possible.

SUMMARY

According to an embodiment, a fluidics module rotatable about a rotational center may have: a first chamber including a fluid outlet; a compression chamber; a second chamber including a fluid inlet; a first fluid channel between the fluid outlet of the first chamber and the compression chamber; a second fluid channel between the compression chamber and the fluid inlet of the second chamber, wherein a liquid may be centrifugally driven through the first fluid channel from the first chamber into the compression chamber, wherein the second fluid channel includes at least one portion whose beginning is located further outward radially than its end, wherein a flow resistance of the second fluid channel for a flow of liquid from the compression chamber to the second chamber is smaller than a flow resistance of the first fluid channel for a flow of liquid from the compression chamber to the first chamber, and wherein, upon rotation of the fluidics module, a compressible medium within the compression chamber may be trapped and compressed by a liquid driven from the first chamber into the compression chamber by centrifugal force, and wherein liquid may be driven into the second chamber from the compression chamber through the second fluid channel by a reduction of the rotational frequency and by consequent expansion of the compressible medium.

According to another embodiment, a device for pumping a liquid may have: a fluidics module as claimed in claim 1, a drive configured to: subject the fluidics module to such a rotational frequency, in a first phase, that liquid is driven from the first chamber through the first fluid channel into the compression chamber, where a compressible medium is thus trapped and compressed, filling levels of the liquid in the first fluid channel, the compression chamber and the second fluid channel adopting a state of equilibrium; and reduce the rotational frequency in a second phase such that the compressible medium within the compression chamber will expand and thereby drive liquid from the compression chamber through the second fluid channel into the second chamber.

According to another embodiment, a method of pumping a liquid may have the steps of: introducing a liquid into the first chamber of a fluidics module as claimed in claim 1; subjecting the fluidics module to a rotational frequency in order to drive liquid from the first chamber through the first fluid channel into the compression chamber, the compressible medium being trapped and compressed within the compression chamber, and filling levels of the liquid in the first fluid channel, the compression chamber and the second fluid channel adopting a state of equilibrium; and reducing the rotational frequency, the compressible medium within the compression chamber expanding and, thereby, liquid being driven from the compression chamber through the second fluid channel into the second chamber.

Embodiments of the invention are based on the finding that by adjusting the flow resistances of the inlet channel between the first chamber and the compression chamber and of the outlet channel between the compression chamber and the second chamber it is possible to enable reverse pumping of a liquid in centrifugal systems in a flexible manner. Inward pumping may take place up to a location which is located further inward radially than that location from where the pumping took place. Thus, in embodiments of the invention, the fluid inlet of the second chamber may be located further inward radially than the fluid outlet of the first chamber. In embodiments of the invention, the entire second chamber may be located further inward radially than the first chamber. Thus, embodiments of the invention enable radially inward pumping of liquid in a flexible manner since liquids may also be pumped to positions that are located further inward radially than the starting position.

A volume of the liquid which is driven from the first chamber into the compression chamber is such that, upon rotation at a sufficient rotational frequency, a state of equilibrium of the filling levels in the first fluid channel, in the compression chamber and in the second fluid channel may be achieved. In this context, the rotational frequency is sufficiently high for applying such a centrifugal force to the liquid that the compressible medium within the compression chamber is compressed sufficiently, so as to then, upon reduction of the rotational frequency, drive liquid from the compression chamber through the second fluid channel into the second chamber.

The compression chamber is a non-vented chamber in order to enable compressing of the compressible medium. In embodiments, the compression chamber comprises no fluid openings except for the fluid inlet(s) connected to the first fluid channel(s), and for the fluid outlet(s) connected to the second fluid channel(s).

The second chamber may be any fluidic structure, for example a continuative fluidic structure coupled to fluidics structures connected downstream in terms of the flow direction.

In embodiments, the compression chamber comprises a fluid inlet and a fluid outlet, the first fluid channel connecting the fluid outlet of the first chamber to the fluid inlet of the compression chamber, and the second fluid channel connecting the fluid outlet of the compression chamber to the fluid inlet of the second chamber. In embodiments, the compression chamber comprises a fluid opening fluidically coupled to a channel section into which the first fluid channel and the second fluid channel lead.

In embodiments of the invention, the flow cross-section of the second fluid channel is larger than the flow cross-section of the first fluid channel so as to thus implement a lower flow resistance of the second fluid channel. In embodiments of the invention, the second fluid channel may be accordingly shorter than the first fluid channel so as to implement a lower flow resistance than the first fluid channel even in the event of an equal or smaller flow cross-section. In embodiments of the invention, the flow resistance of the first fluid channel may be at least twice as large as that of the second fluid channel. In embodiments, the first fluid channel may comprise a valve for increasing the fluidic resistance of the first fluid channel. The valve may represent a higher flow resistance for a flow of fluid from the first chamber to the compression chamber than in the opposite direction. For example, the valve may be configured to enable a flow of fluid, caused by centrifugation, from the first chamber into the compression chamber, but to prevent backflow from the compression chamber into the first chamber. For example, the valve may comprise a sphere or a back-pressure valve.

In embodiments of the invention, the second fluid channel may comprise a syphon.

Embodiments of the invention thus rely on a pneumatic pumping effect in combination with inlet channels and outlet channels for the compression chamber which have different geometries, such that the outlet channel provides a lower flow resistance than the inlet channel. Thus, the hydrodynamic properties of liquid may be exploited for pumping it inward. A corresponding approach is not known from conventional technology. In this aspect, it shall be noted that according to the above-mentioned document by Gorkin, an inward pumping effect is not achieved by different flow resistances but by a corresponding radial arrangement of the channels and structures in order to enable filling of the syphon and emptying of the pressure chamber above the syphon.

In embodiments of the invention, the pumping effect described may be supported thermally or by means of gas evolution. To this end, embodiments of the present invention may comprise a pressure source for generating a pressure within the compression chamber and/or a heat source for heating the compressible medium within the compression chamber.

Embodiments of the present invention thus relate to geometric structures and methods, by means of which liquids may be pumped inward in centrifuge rotors following compression of a compressible medium due to different hydrodynamic resistances. Further embodiments of the invention relate to geometric structures and methods, by means of which liquids are pumped inward in centrifuge rotors following compression of a compressible medium due to different hydrodynamic resistances so as to thereby prime a syphon.

Embodiments of the present invention thus enable passive inward pumping of liquid in centrifuge rotors to positions that may be located further inward radially than the starting position.

BRIEF DESCRIPTION OF THE DRAWINGS

Embodiments of the present invention will be detailed subsequently referring to the appended drawings, in which.

DETAILED DESCRIPTION OF THE INVENTION

Before explaining embodiments of the invention in more detail, it shall initially be pointed out that embodiments of the present invention are applied, in particular, in the field of centrifugal microfluidics, which is about processing liquids within the nanoliter to milliliter ranges. Accordingly, the fluidics structures may have suitable dimensions within the micrometer range for handling corresponding volumes of liquid. The fluidics structures (geometric structures) as well as the associated methods are suited for pumping liquid radially inward in centrifuge rotors. In this context, inward pumping is understood to mean transporting liquid from a radially outer position to a radially inner position, in each case in relation to a rotational center about which the fluidics structure may be rotated. Passive inward pumping is understood to mean inward pumping which is controlled exclusively by the rotational frequency of the rotor and the fluidic resistances of the feed and discharge conduits to and from a compression chamber.

Whenever the expression "radial" is used, what is referred to is radial in terms of the rotational center about which the fluidics module and/or the rotor is rotatable. In the centrifugal field, thus, a radial direction away from the rotational center is radially falling, and a radial direction toward the rotational center is radially rising. A fluid channel whose beginning is closer to the rotational center than its end is therefore radially falling, whereas a fluid channel whose beginning is spaced further apart from the rotational center than its end is radially rising.

Figure 1:
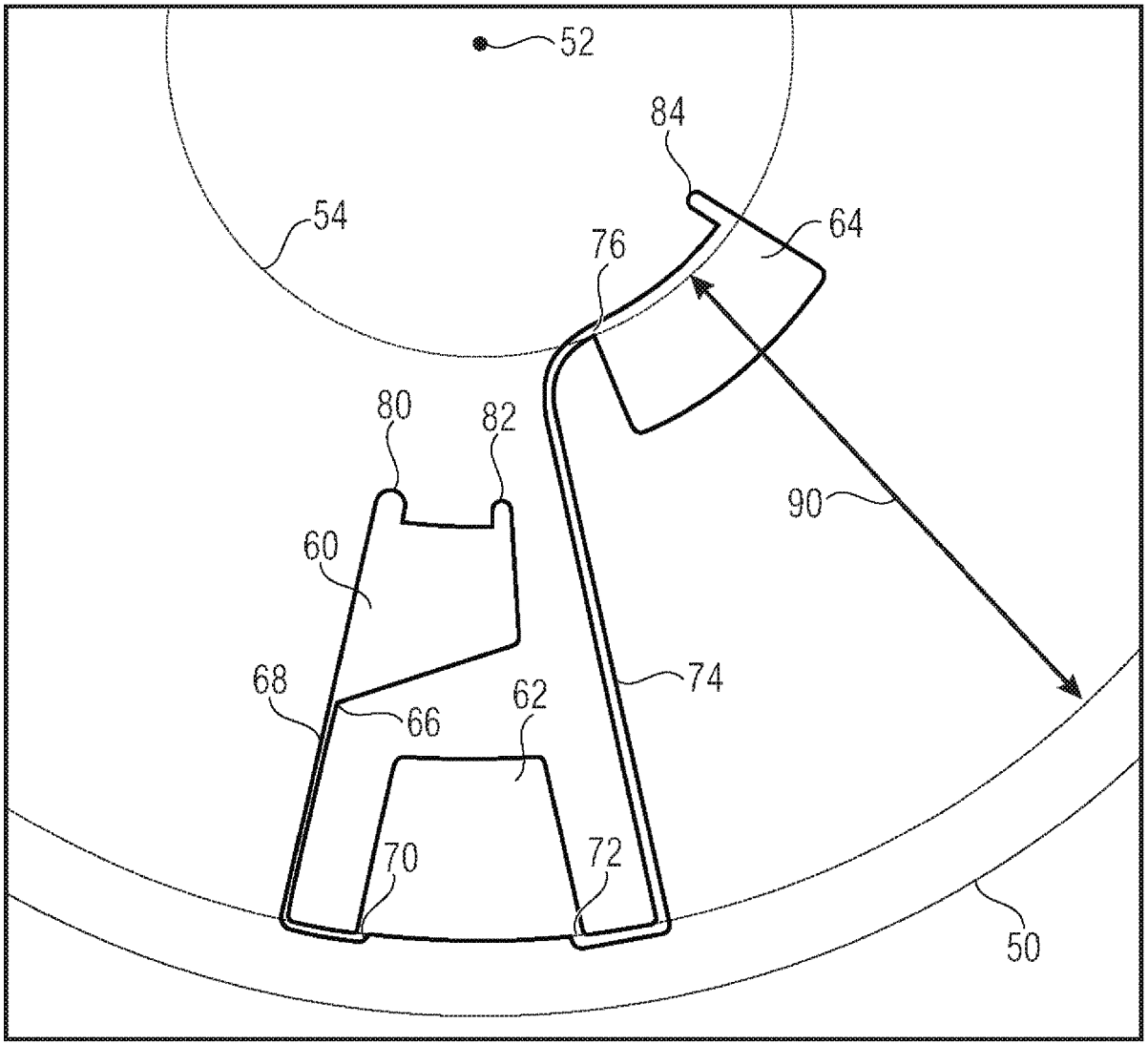
FIG. 1 schematically shows a top view of a section of an embodiment of an inventive fluidics module.
Figure 2:
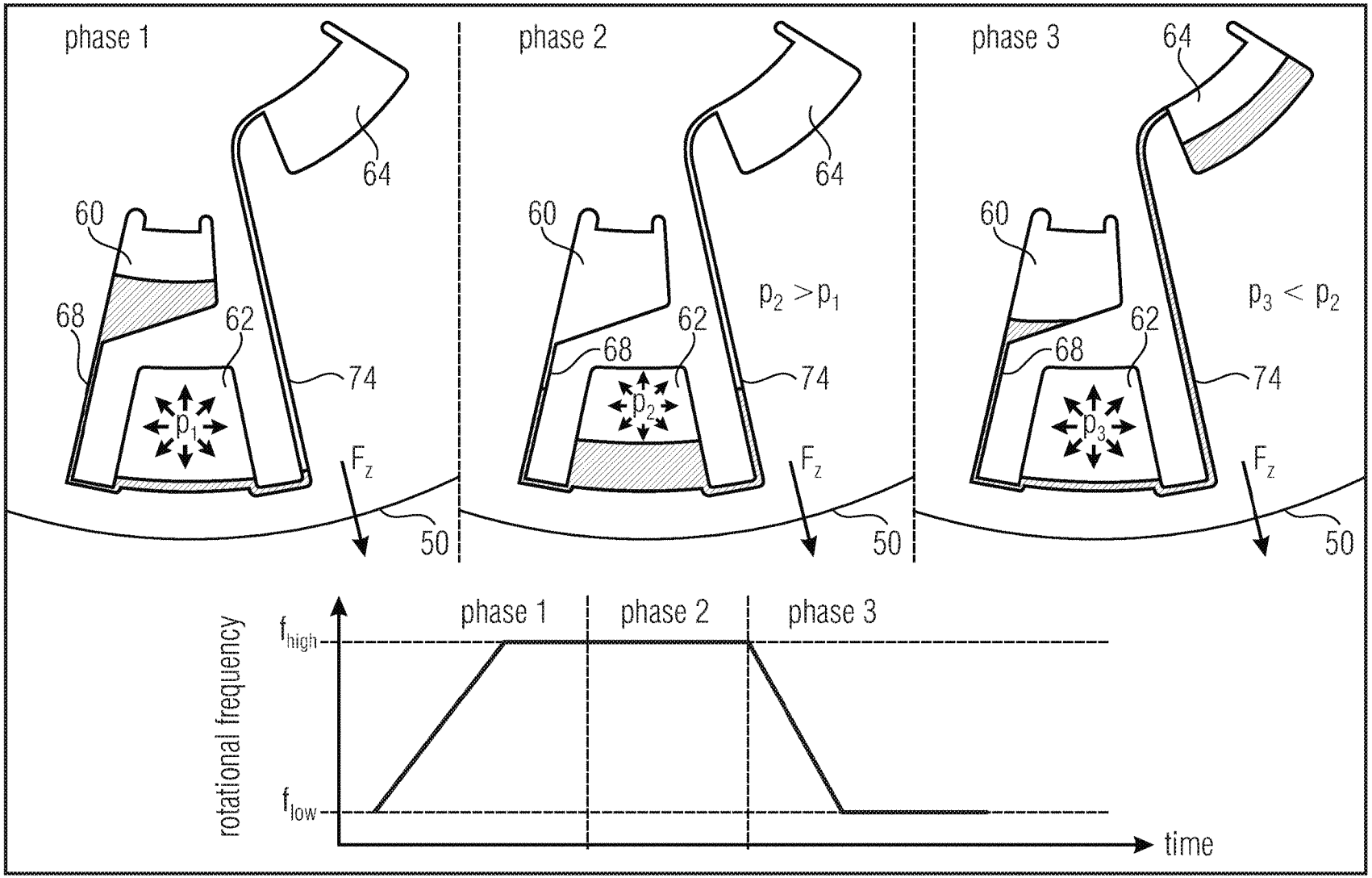
FIG. 2 shows schematic representations for illustrating the function of the embodiment shown in FIG. 1.
Figure 3:
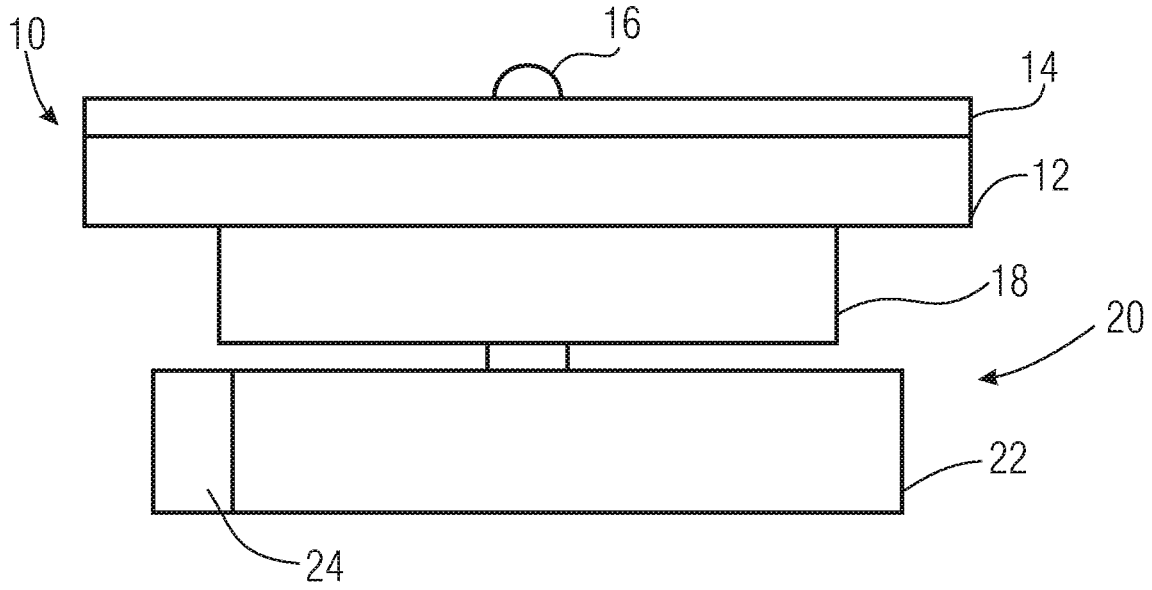
FIGS. 3 and 4 show schematic side views for illustrating embodiments of inventive devices.
Figure 4:
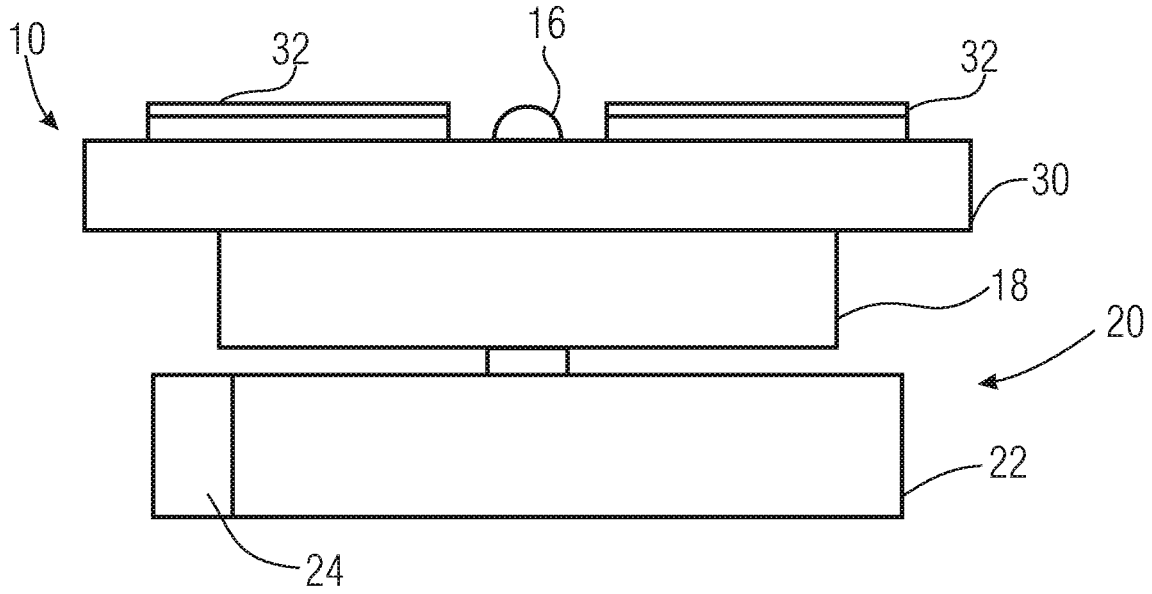

Before addressing in more detail an embodiment of a fluidics module having corresponding fluidics structures with reference to FIGS. 1 and 2, a description shall initially be given of embodiments of an inventive device with reference to FIGS. 3 and 4.

FIG. 3 shows a device having a fluidics module 10 in the form of a rotational body comprising a substrate 12 and a cover 14. The substrate 12 and the cover 14 may be circular in top view, having a central opening by means of which the rotational body 10 may be mounted to a rotating part 18 of a drive means via a common fastener 16. The rotating part 18 is rotatably mounted on a stationary part 22 of the drive means 20. The drive means may be a conventional centrifuge having an adjustable rotational speed, or a CD or DVD drive, for example. A control means 24 may be provided which is configured to control the drive means 20 so as to subject the rotational body 10 to rotations at different rotational frequencies. As is obvious to persons skilled in the art, the control means 24 may be implemented, for example, by a computing means programmed accordingly or by a user-specific integrated circuit. The control means 24 may further be configured to control the drive means 20 upon manual inputs on the part of a user so as to effect the rotations of the rotational body. In any case, the control means 24 is configured to control the drive means 20 so as to subject the rotational body to the rotational frequencies that may be used so as to implement the invention as is described here. A conventional centrifuge having only one rotational direction may be used as the drive means 20.

The rotational body 10 comprises the fluidics structures that may be used. The fluidics structures may that may be used be formed by cavities and channels in the cover 14, the substrate 12 or in the substrate 12 and the cover 14. In embodiments, fluidics structures may be formed in the substrate 12, for example, whereas fill-in openings and venting openings are formed in the cover 14.

In an alternative embodiment shown in FIG. 4, fluidics modules 32 are inserted into a rotor, and together with the rotor 30 they form the rotational body 10. The fluidics modules 32 may each comprise a substrate and a cover, wherein, again, corresponding fluidics structures may be formed. The rotational body 10 formed by the rotor 30 and the fluidics modules 32, again, may be subjected to a rotation by a drive means 20 controlled by the control means 24.

In embodiments of the invention, the fluidics module and/or the rotational body comprising the fluidic structures may be formed from any suitable material, for example plastic, such as PMMA (polymethyl methacrylate, polycarbonate, PVC, polyvinyl chloride) or PDMS (polydimethylsiloxane), glass or the like. The rotational body 10 may also be considered to be a centrifugal-microfluidic platform.

FIG. 1 shows a top view of a section of an inventive fluidics module 50 wherein the cover has been omitted, so that the fluidics structures can be seen. The fluidics module 50 shown in FIG. 1 may have the shape of a disc, so that the fluidics structures are rotatable about a rotational center 52. The disc may comprise a central hole 54 for attachment to a drive means, as was explained above with reference to FIGS. 3 and 4, for example.

The fluidics structures are configured to pump fluid radially inward within the fluidics module 50. The fluidics structures comprise a first chamber 60, which represents an inlet chamber, a compression chamber 62, and a second chamber 64 separate from the first chamber 60, which represents a receiving chamber. A fluid outlet 66 of the inlet chamber 60, which in the embodiment represented is arranged at a radially outer end of the inlet chamber 60, is fluidically connected to a fluid inlet 70 of the compression chamber 62 via a first fluid channel 68. The fluid inlet 70 may be located at a radially outer area of the compression chamber 62. A fluid outlet 72 of the compression chamber 62 is fluidically connected to a fluid inlet 76 of the receiving chamber 64 via a second fluid channel 74. The fluid outlet 72 is arranged at a radially outer area of the compression chamber 62, said radially outer area being spaced apart from the fluid inlet 70 in the azimuthal direction. The second fluid channel 74 comprises a radially inwardly extending portion and thus represents a radial rise for a flow of liquid from the compression chamber 62 to the second chamber 64.

As is schematically indicated in FIG. 1, the inlet chamber 60 may comprise a fill-in area 80 and a venting area 82. The receiving chamber 64 may comprise a venting area 84. The fill-in area 80 and the venting areas 82 and 84 may be fluidically connected to a corresponding fill-in opening (not shown) and venting openings (not shown).

As may be seen in FIG. 1, the flow cross-section of the second fluid channel 74, which fluidically connects the fluid outlet 72 of the compression chamber 62 to the fluid inlet 76 of the receiving chamber 64, is larger than the flow cross-section of the fluid channel 68, which connects the fluid outlet 66 of the inlet chamber 60 to the fluid inlet 70 of the compression chamber 62. Thus, the second fluid channel 74 offers a lower flow resistance to a flow of liquid from the compression chamber 62 to the receiving chamber 64 than the first fluid channel 68 offers for a flow of liquid from the compression chamber 62 to the inlet channel 60.

A pumping height, via which a liquid may be pumped from the compression chamber 62 into the receiving chamber 64, is designated by reference numeral 90 in FIG. 1.

In the operation, which will be explained below with reference to FIG. 2, a phase 1 initially comprises introducing a volume of a liquid into the inlet chamber 60 (for example via the fill-in area 80). In this context, the inlet channel 68 will fill up in a capillary manner, or its fill-in operation is supported by rotation of the fluidics module at a low rotational frequency $f_{low}$. Once the inlet chamber 60 has been filled, the rotational frequency is increased from the low frequency $f_{low}$ to a high frequency $f_{high}$. Due to the centrifugal force $F_z$ acting as a result of this increase in the rotational frequency, the liquid is forced from the inlet chamber 60 through the inlet channel 68 into the compression chamber 62 and into the outlet channel 74. In this context, the frequency $f_{high}$ is sufficiently high so as to apply such a centrifugal force to the liquid that, as a result, a compressible medium located within the compression chamber 62, for example air, is compressed as is indicated in phase 2 of FIG. 2. Due to this compression, the pressure within the compression chamber 62 increases from a pressure $p_1$, as is shown in phase 1 in FIG. 2, to a pressure $p_2$, as is shown in phase 2 in FIG. 2. In the event of a steady rotational frequency, the filling levels of the liquid in the inlet channel 68, the outlet channel 74 and the compression chamber 62 adopt a state of equilibrium and/or a position of equilibrium, as may be seen from the filling levels in phase 2 in FIG. 2.

Starting from this state, the rotational frequency is reduced so rapidly, in phase 3 shown in FIG. 2, that the pressure within the compression chamber 62 is decreased in that a large part of the sample liquid escapes via the path of the lowest resistance. This path of the lowest resistance is the outlet channel 74, which offers a lower flow resistance for the flow of liquid to the receiving chamber 64 than the inlet channel 68 offers for a flow of liquid to the inlet chamber 60. In accordance with the reduction in pressure $p_3$ within the compression chamber 62, the air located within the compression chamber 62 will expand.

In embodiments of the invention, the low rotational frequency $f_{low}$ may also become zero or adopt negative values, which indicates a reverse rotational direction.

In embodiments of the invention, the fluidics module may be realized monolithically. Embodiments of the invention may be configured for pumping any sample liquids, such as water, blood or other suspensions. Embodiments of the invention allow that at a rotational frequency of about 6 Hz as a low rotational frequency and of about 75 Hz as a high rotational frequency, and at a rotational deceleration of about 32 Hz/s, 75% of a sample of water of 200 μL may be conveyed radially inward within about 3 seconds over a pumping height of about 400 mm.

In the embodiment described, only one inlet channel 68 and one outlet channel 74 are provided. In alternative embodiments, several inlet channels may be provided between the inlet chamber 60 and the compression chamber 62, and/or several outlet channels may be provided between the compression chamber 62 and the receiving chamber 64.

As is shown in FIG. 1, the fluid outlet 66 is located further inward radially, in relation to the rotational center 52, than the fluid inlet 70 of the compression chamber 62, so that the inlet channel 68 is radially declining. The fluid outlet 72 of the compression chamber 62 is located further outward radially than the fluid inlet 76 of the receiving chamber 64, so that the fluid channel 74 is radially rising.

In the embodiment shown in FIG. 1, the entire receiving chamber 64 is located further inward radially than the inlet channel 60. Thus, embodiments of the invention enable a net pumping action directed radially inward.

In alternative embodiments, the fluid channel 74 may also comprise radially declining portions. For example, the fluid channel 74 may comprise a syphon via which the compression chamber 62 is fluidically connected to the receiving chamber 64. The outlet of said syphon may be located further outward radially than the fluid outlet of the compression chamber 62, it being possible for the compression chamber to be via a sucking action within the syphon following filling (priming) of the syphon, which is effected by the reduction of the rotational frequency.

Figure 5:
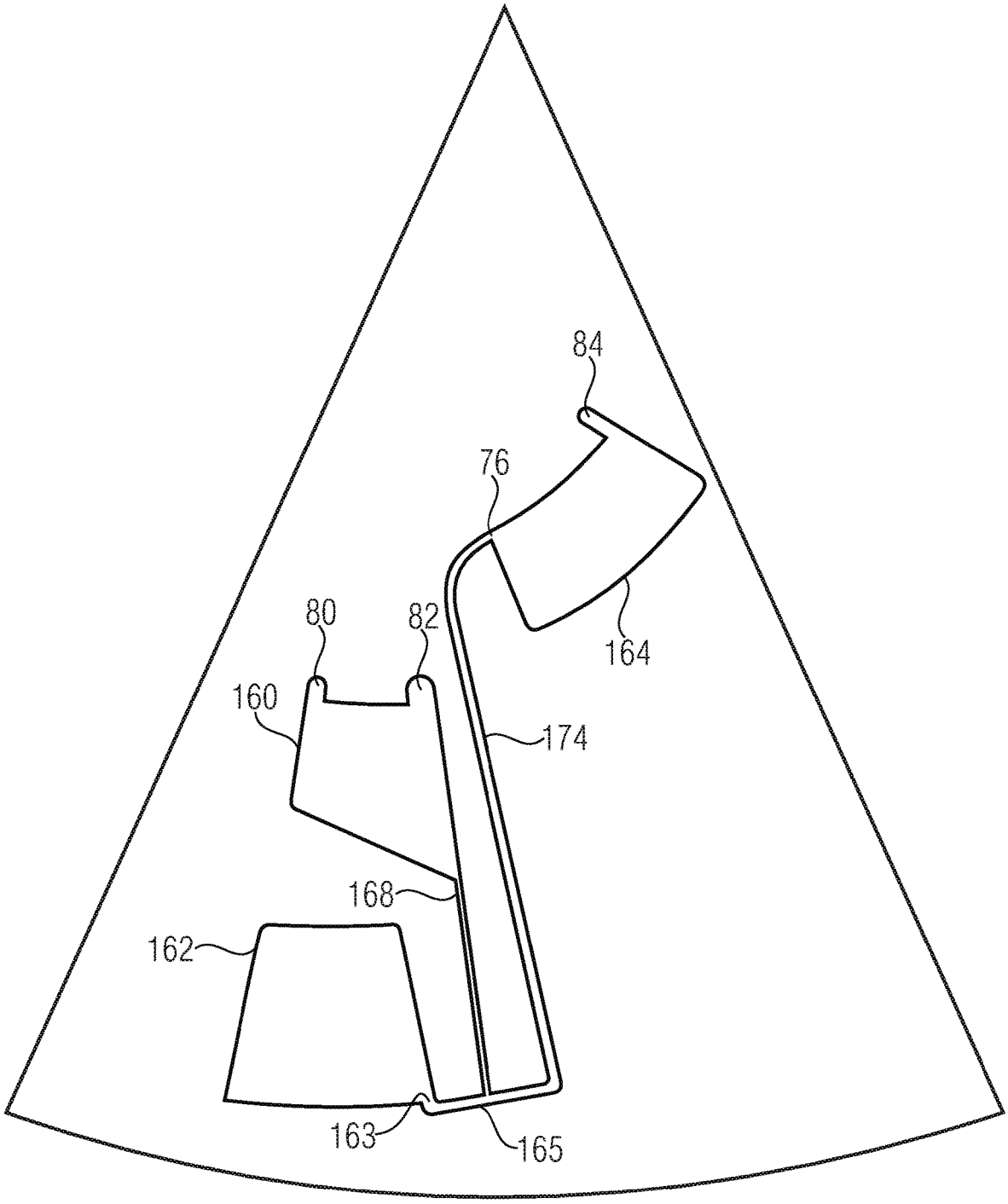
FIG. 5 shows a schematic top view of a section of an alternative embodiment of an inventive fluidics module.

FIG. 5 shows alternative fluidics structures of an embodiment of a fluidics module. A compression chamber 162 comprises only one fluid opening 163 at a radially outer area, which may be referred to as a fluid inlet/outlet. A first fluid channel 168 is provided between the fluid outlet 66 of a first chamber (reservoir) 160 and the compression chamber 162, and a second fluid channel 174 is provided between the compression chamber 162 and the fluid inlet 76 of a second chamber (collecting chamber) 164, which is separate from the first chamber 160. The chambers 160 and 164, in turn, may be provided with a corresponding fill-in area 80 and venting areas 82 and 84. As is shown in FIG. 5, the first fluid channel 168 and the second fluid channel 174 lead into a channel section 165 fluidically connected to the fluid opening 163. By means of the fluidics structure shown in FIG. 5, inward pumping may be implemented in a manner analogous to that described above with reference to FIGS. 1 and 2 in that the fluidics module is subjected to corresponding rotations. Thus, the explanations shall apply accordingly to the embodiment shown in FIG. 5.

In embodiments of the present invention, liquid is thus pumped radially inward within a rotor. In this context, initially, liquid is pumped radially outward at a high rotational frequency through one or more narrow inlet channels (which exhibit high hydrodynamic resistance) into a chamber wherein a compressible medium is trapped and compressed. At the same time, one or more further outlet channels (which exhibit a low hydrodynamic resistance), which are connected to the compression chamber and to a receiving chamber located radially inward, are filling up. Due to a rapid deceleration of the rotor to a low rotational frequency, the compressive medium will expand again. A large part of the liquid is pumped through the outlet channel(s) into the receiving chamber, whereas only a smaller part of the liquid is pumped back into the inlet channel(s).

In embodiments of the invention, the pumping operation may be supported by additional expansion of the compressible medium within the compression chamber. Such additional expansion may be thermally induced in that corresponding heating is provided. Alternatively, such additional expansion may be caused by gas evolution due to chemical reactions. Again, as an alternative, such an expansion may be supported by additional external pressure generation by means of a corresponding pressure source.

As was explained above, the different flow resistances may be achieved in that the inlet channel comprises a smaller flow cross-section than the outlet channel, so that the narrow inlet channel represents a high resistance for the liquid to be processed, whereas the wide outlet channel represents a very low resistance. In alternative embodiments, the flow resistance might be achieved by adjusting the lengths of the inlet channel and of the outlet channel accordingly since the flow resistance also depends on the length of a fluid channel in addition to the flow cross-section, as is known.

Embodiments of the present invention thus enable passive inward pumping in centrifuge rotors. Unlike conventional methods, the present invention represents a passive method requiring no additional media (liquid, wax, etc.) in the rotor and no additional external elements such as pressure sources or heat sources, for example, and thus involves lower expenditure and lower cost. In embodiments of the present invention, such external elements may be provided to be merely supportive. In addition, embodiments of the present invention enable clearly faster pumping than previous methods, merely several seconds being taken for a few 100 μL, as opposed to several minutes in accordance with known methods. Moreover, the present invention is advantageous in that the pumping method may be repeated any number of times by means of the fluidic structure described.

It is obvious to persons skilled in the art that the fluidics structures described represent only specific embodiments and that alternative embodiments may deviate in terms of size and shape. Any persons skilled in the art may readily appreciate any fluidics structures and rotational frequencies which deviate from the fluidics structures and rotational frequencies described while being suitable for inward pumping of a desired volume of liquid in accordance with the inventive approach. In addition, it is obvious to any person skilled in the art in what manner the volume of the compression chamber and the flow resistances of the fluid channels may be implemented in order to achieve the inventive effect.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A fluidics module rotatable about a rotational center, comprising:

a first chamber including a fluid outlet;

a compression chamber;

a second chamber separate from the first chamber and including a fluid inlet;

a first fluid channel between the fluid outlet of the first chamber and the compression chamber;

a second fluid channel between the compression chamber and the fluid inlet of the second chamber, wherein the first fluid channel and the second fluid channel are fluidically coupled to the compression chamber at at least one radially outer area of the compression chamber, wherein a liquid may be centrifugally driven through the first fluid channel from the first chamber into the compression chamber, wherein the second fluid channel includes at least one portion whose beginning is located further outward radially than its end, wherein a flow resistance of the second fluid channel for a flow of liquid from the compression chamber to the second chamber is smaller than a flow resistance of the first fluid channel for a flow of liquid from the compression chamber to the first chamber, wherein, upon rotation of the fluidics module, a compressible medium within the compression chamber may be trapped and compressed by a liquid driven from the first chamber into the compression chamber by centrifugal force, and wherein liquid may be driven into the second chamber from the compression chamber through the second fluid channel by a reduction of a rotational frequency and by a consequent expansion of the compressible medium, and wherein the compression chamber permits the liquid driven from the first chamber into the compression chamber by centrifugal force to trap and compress the compressible medium in the compression chamber.

2. The fluidics module as claimed in claim 1, wherein a flow cross-section of the second fluid channel is larger than a flow cross-section of the first fluid channel.

3. The fluidics module as claimed in claim 1, wherein the fluid inlet of the second chamber is located further inward radially than the fluid outlet of the first chamber.

4. The fluidics module as claimed in claim 3, wherein the entire second chamber is located further inward radially than the first chamber.

5. The fluidics module as claimed in claim 1, wherein the second fluid channel comprises a syphon.

6. The fluidics module as claimed in claim 1, wherein the compression chamber comprises a fluid inlet to which the first fluid channel is fluidically coupled at the at least one radially outer area of the compression chamber, and a fluid outlet to which the second fluid channel is fluidically coupled at the at least one radially outer area of the compression chamber.

7. The fluidics module as claimed in claim 1, wherein the compression chamber comprises a fluid opening fluidically coupled to a channel section into which the first fluid channel and the second fluid channel lead.

8. The fluidics module as claimed in claim 1, wherein the first fluid channel comprises a valve which represents a higher flow resistance for a flow of fluid from the first chamber to the compression chamber than in the opposite direction.

9. A device for pumping a liquid, comprising:

a fluidics module as claimed in claim 1, a drive configured to:

subject the fluidics module to a first rotational frequency, in a first phase, that drives liquid from the first chamber through the first fluid channel into the compression chamber, where the compressible medium is thus trapped and compressed, filling levels of the liquid in the first fluid channel, the compression chamber and the second fluid channel adopting a state of equilibrium; and reduce the rotational frequency in a second phase such that the compressible medium within the compression chamber will expand and thereby drive liquid from the compression chamber through the second fluid channel into the second chamber.

10. The device as claimed in claim 9, further comprising:

a unit that supports expansion of the compressible medium upon reduction of the rotational frequency.

11. The device as claimed in claim 10, wherein the unit for supporting comprises at least one of a pressure source for producing a pressure within the compression chamber, a heat source for heating the compressible medium, and a unit for effecting gas evolution due to chemical reactions.

12. The device as claimed in claim 1, wherein the compression chamber is a non-vented chamber.

13. A method of operating a fluidics module rotatable about a rotational center, the fluidics module comprising a first chamber including a fluid outlet, a compression chamber, a second chamber separate from the first chamber and including a fluid inlet, a first fluid channel between the fluid outlet of the first chamber and the compression chamber, and a second fluid channel between the compression chamber and the fluid inlet of the second chamber, wherein the first fluid channel and the second fluid channel are fluidically coupled to the compression chamber at at least one radially outer area of the compression chamber, wherein the second fluid channel includes at least one portion whose beginning is located further outward radially than its end, wherein a flow resistance of the second fluid channel for a flow of liquid from the compression chamber to the second chamber is smaller than a flow resistance of the first fluid channel for a flow of liquid from the compression chamber to the first chamber, the method comprising:

rotating the fluidics module to centrifugally drive a liquid through the first fluid channel from the first chamber into the compression chamber to thereby trap and compress a compressible medium within the compression chamber by the liquid, and reducing the rotational frequency so that the compressible medium in the compression chamber expands to thereby drive at least a part of the liquid from the compression chamber through the second fluid channel into the second chamber.

14. The method as claimed in claim 13, further comprising supporting the expansion of the compressible medium upon reduction of the rotational frequency.

15. The method as claimed in claim 14, wherein supporting comprises at least one of subjecting the compressible medium to a pressure, heating the compressible medium, and effecting gas evolution within the compression chamber.

* * * * *